United States Patent [19]

Gardetto

[11] 3,971,558

[45] July 27, 1976

[54] BASE MARKER FOR BASEBALL

[76] Inventor: Alfred D. Gardetto, 16880 West Sundown Court, New Berlin, Wis. 53151

[22] Filed: July 9, 1973

[21] Appl. No.: 377,493

[52] U.S. Cl. ..... 273/25
[51] Int. Cl.[2] ..... A63B 71/00
[58] Field of Search ..... 273/25, 100, 104; 248/333

[56] References Cited

UNITED STATES PATENTS

| | | | |
|---|---|---|---|
| 1,230,503 | 6/1917 | Miller | 273/100 |
| 2,122,266 | 6/1938 | Seys | 273/25 |
| 3,474,996 | 10/1969 | Stamm | 273/25 |
| 3,508,747 | 4/1970 | Orsatti | 273/25 |
| 3,823,942 | 7/1974 | Duncan | 273/100 |

*Primary Examiner*—Richard J. Apley
*Assistant Examiner*—T. Brown
*Attorney, Agent, or Firm*—Wheeler, Marsell, House & Fuller

[57] ABSTRACT

A flat plate has an opening in the central portion thereof for receiving a plug which is dimensioned to removably fit within the opening. Fasteners such as screw threads, snap fittings, or the like are provided on the plug and in the opening for removably holding the plug in the opening. Two spikes or pegs of unequal length are removably fastened to the plug and project downwardly therefrom for securing the plate to the ground. The bottom of the plate has recessed portions with a pair of clips being mounted in one of the recessed portions for storing the spikes in a safe, convenient location when the marker is not in use. In one embodiment of the invention, two plugs and two openings are used, one for each of the two spikes.

2 Claims, 10 Drawing Figures

BASE MARKER FOR BASEBALL

BACKGROUND OF THE INVENTION

This invention relates to base markers for baseball diamonds. In the past, base markers have been made of sand bags or similar filled bags which are liable to be punctured by the players' spikes and which are relatively difficult to carry and to store. Such bags are also difficult to secure to the ground because they have no rigid surface that a spike or peg may be attached to.

SUMMARY OF THE INVENTION

The principal object of this invention is to provide a durable, easily installed base marker which is easy to carry and to store.

Another object of this invention is to provide a base marker of the above-noted character which is relatively inexpensive in cost.

A further object of this invention is to provide a base marker having recessed clips to which the spikes or pegs that secure the base marker to the ground may be clipped when the marker is stored.

An additional object of this invention is to provide a base marker of the above-noted character in which the spikes or pegs that secure the base marker to the ground are removably attached to a removable plug which fits into an opening in the marker and may be stored in the opening when the marker is stored.

Other objects and advantages of the invention will become apparent to those skilled in the art from the following description of several illustrative embodiments thereof.

In accordance with this invention, the foregoing objects are attained by providing a flat plate having at least one opening in the central portion thereof for receiving a plug which is dimensioned to removably fit within the opening. Fastening means such as screw threads, snap fittings, or the like are provided on the plug and in the opening for removably holding the plug in the opening. At least one spike or peg is removably fastened to the plug and projects downwardly therefrom for securing the plate to the ground. The bottom of the plate has recessed portions with at least one clip being mounted in one of the recessed portions for holding the spike or peg in a safe, convenient location when the marker is not in use. In the preferred embodiment, two spikes of unequal length are used to secure the plate to the ground and two or more recessed clips are provided for holding the spikes when the marker is stored. Two removable plugs and two openings may be used if desired, one for each of the two spikes. Alternately, both spikes may be removably attached to a single plug.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
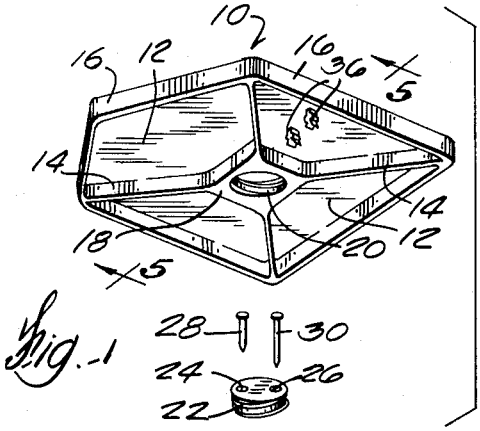
FIG. 1 is an exploded perspective view of the lower side of one embodiment of the invention.
Figure 5:
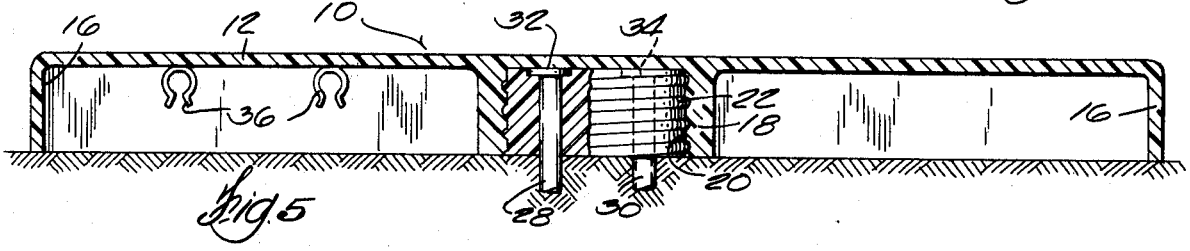
FIG. 5 is a cross-sectional view taken on the line 5—5 of FIG. 1 showing the embodiment of FIG. 1 attached to the ground.

Referring to FIGS. 1 and 5, one embodiment of the invention includes a flat plate 10 which may be made of polypropylene plastic or other suitable material. The lower side of plate 10 has a plurality of recesses 12 which are separated by radial ribs 14 and are surrounded on their outer periphery by peripheral ribs 16. The recesses 12 serve to lighten the weight of plate 10 and also serve a storage function as will be described hereinafter. The ribs 14 and 16 serve to stiffen the plate 10. A hub 18 having a central opening 20 is provided in the central portion of the plate 10. The opening 20 does not extend completely through hub 18 and is only accessible from the bottom of plate 10 as best shown in FIG. 5. Opening 20 is screw threaded to receive a threaded polypropylene plug 22 which is dimensioned to be removably secured within opening 20.

Two axially directed bores 24 and 26 extend through plug 22 to receive two metal spikes or pegs 28 and 30 which are unequal in length as best shown in FIG. 1. The bores 24 and 26 are countersunk on their upper end for receiving the heads 32 and 34 of spikes 28 and 30 as shown in FIG. 5. The spikes 28 and 30 serve to hold the plate 10 in a predetermined position on the ground and are unequal in length because it has been found that the plate 10 can be more accurately and more easily affixed to the ground in a predetermined position with unequal length spikes than with equal length spikes. The shorter spike is preferably about 2 inches shorter than the longer spike, and the longer spike is about 4¼ inches long. It should be understood that the invention is not limited to these particular lengths, since larger or smaller spikes may be employed if desired. The object is to keep the base or pitcher's marker reasonably stationary.

Two or more resilient clips 36 are mounted in one of the recesses 12 for holding the spikes 28 and 30 when the base marker in storage. Before the base marker is stored, the spikes 28 and 30 are withdrawn from plug 22 and placed in clips 36. The plug 22 is then screwed into opening 20 without the spikes 28 and 30. This makes a compact unit in which plug 22 and spikes 28 and 30 are stored in a recessed location and are readily accessible when the base marker is to be put into use. The stored configuration of parts is also easy to carry and the points of spikes 28 and 30 are covered by the ribs 14 and 16 so that the spikes will not injure the person carrying the unit or tear his clothes. To install the base markers in position, the plug 22 is screwed out of opening 20 and spikes 28 and 30 are removed from clips 36 and placed in openings 24 and 26 of plug 22, which is then re-screwed into opening 20. The spikes 28 and 30 are then driven into the ground at the predetermined base location to hold the plate 10 in place.

In cases where the plate 10 is made out of molded polypropylene, or other resilient plastic material, the clips 36 may be integrally molded with the top of plate 10. In other cases, the clips 36 may be made separately and attached to the bottom of plate 10 by any suitable fastening means.

Figure 2:
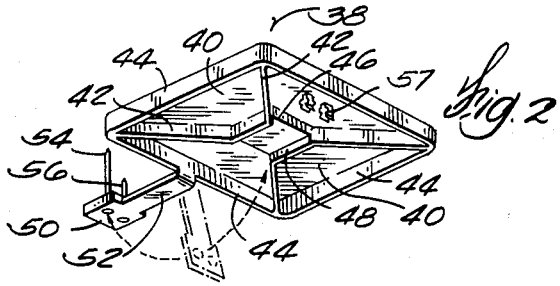
FIG. 2 is an exploded perspective view of the lower side of another embodiment of the invention.

FIG. 2 shows a second embodiment of the invention that includes a flat plate 38 having recessed portions 40 which are bounded by radial ribs 42 and peripheral ribs 44. A hub 46 having a central opening 48 is provided in the center of the plate 38 and a plug 50 is swingably mounted on an arm 52 in such position that the plug 50 may be inserted into opening 48 by swinging arm 52 inwardly as indicated by the dashed lines in FIG. 2. The plate 38, plug 50, and arm 52 are preferably integrally molded of a suitable resilient plastic such as polypropylene or the like. The arm 52 is thin enough to readily bend at its juncture with rib 44 to provide a pivotable attachment thereto. Plug 50 is shaped to be snap fitted into opening 48 and has openings for receiving two spikes 54 and 56 which are unequal in length. When plug 50 is snapped into opening 48, spikes 54 and 56 may be driven into the ground to hold the plate 38 in place as a base marker. When the device is stored, the spikes 54 and 56 may be stored in a pair of clips 57 mounted in one of the recessed portions 40. The pivotable arm 52 allows the plate 38 to be lifted up without dislodging spikes 54 and 56, e.g., by a base runner who slides into plate 38 and catches his spikes on one of the peripheral ribs 44. After plate 38 has been accidentally lifted, it may be easily snapped back in place over plug 50 using hand or foot pressure.

Figure 4:
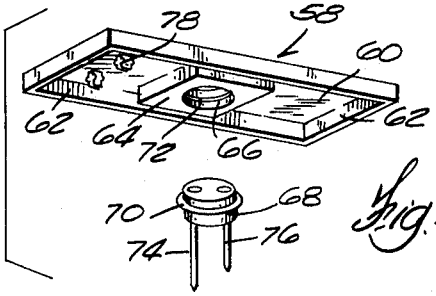
FIG. 4 is an exploded perspective view of the lower side of another embodiment of the invention.

The embodiment of FIG. 2 is shown as being rectangular in shape, but a pentagonal shape could also be employed if desired without changing any of the essential features of this embodiment. Conversely, a rectangular shape could be employed in the embodiment of FIG. 1 in place of the disclosed pentagonal shape. The pentagonal shape of FIG. 1 is used for home plate and the rectangular shape of FIG. 2 is used for first, second, and third bases. A relatively narrow rectangular shape, shown in FIG. 4, is used as a pitcher's mound. For the purposes of this document, the word "base" is defined to include home plate, first, second, and third bases, and the pitcher's mound, all of which must be marked on the playing field.

Figure 8:
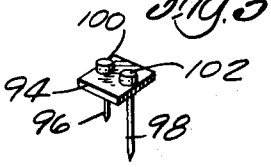
FIG. 8 is a fragmentary cross-sectional view of the central portion of the embodiment shown in FIG. 4.
Figure 8:
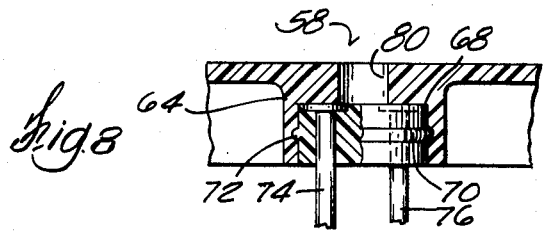

The pitcher's mound shown in FIG. 4 includes a flat plate 58 which has recessed portions 60 surrounded by peripheral ribs 62. A central hub 64 having a round opening 66 is provided in the central portion of plate 58. A plug 68 is shaped and dimensioned to be removably fitted into opening 66 as best shown in FIG. 8. Both the plate 58 and plug 68 are preferably made of a resilient plastic such as polypropylene. A snap-fitting tongue and groove joint is provided for holding the plug 68 in opening 66. In this particular embodiment, a circular tongue 70 is provided on plug 68 and a matching circular groove 72 is provided in opening 66, but this arrangement could be reversed if desired, with the tongue being on the opening 66 and the groove being in the plug 68.

A pair of unequal length spikes 74 and 76 are inserted in corresponding openings in plug 68 and extend downwardly therefrom for securing the plate 58 to the ground in the manner described previously in connection with the embodiment of FIG. 1. When the unit is not in use, the spikes 74 and 76 may be stored in clips 78 which are located within one of the recesses 60. The plug 68 may be stored in opening 66. An opening 80 is provided in the top of plate 58 through which the plug 68 may be pushed out of openings 66 by one of the spikes 74 or 76. Opening 80 is used for removing plug 68 after it has been stored in opening 66 without the spikes 74 or 76. In this case, there is nothing that can be grasped to pull the plug 68 out of opening 66 so it must be pushed out through opening 80 with one of the loose spikes 74 or 76.

Figure 3:
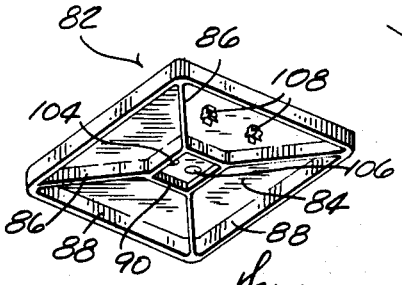
FIG. 3 is an exploded perspective view of the lower side of another embodiment of the invention.

FIG. 3 shows another embodiment of the invention which includes a flat plate 82 having recessed portions 84 which are separated by radial ribs 86 and peripheral ribs 88. A hub 90 having an opening 92 therein is provided in the central portion of plate 82. A plug 94 which carries two unequal length spikes 96 and 98 is dimensioned to be snap-fitted into opening 92. In this particular embodiment of the invention, the heads 100 and 102 of spikes 96 and 98 protrude from the top of plug 94 and fit into corresponding recesses 104 and 106 in the hub 90. Suitable snap latching means, not shown, is formed on plug 94 and opening 92 for removably latching the two together. Any suitable prior art snap latching means may be employed, e.g., a projection on plug 94 and a matching recess in the wall of opening 92. When the spikes 96 and 98 are removed from the plug 94 for storage, they may be stored in clips 108 which are mounted in one of the recesses 84.

Figure 6:
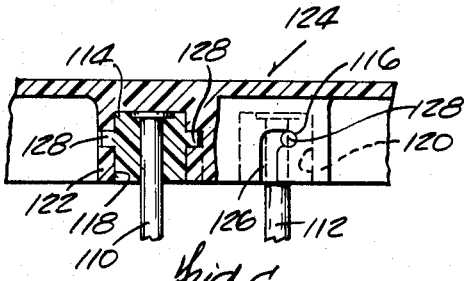
FIG. 6 is a fragmentary cross-sectional view of the central portion of another embodiment of the invention.

FIGS. 6, 7, 9, and 10 show alternate ways for securing a pair of spikes to the central portion of a flat plate. In FIG. 6, a pair of spikes 110 and 112 are mounted in separate plugs 114 and 116 which fit into corresponding openings 118 and 120 in a hub 122 of a flat plate 124. The openings 118 and 120 are slotted as at 126 to receive ears 128 which project from the sides of plugs 114 and 116. The slots 126 are oriented radially at their upper ends to lock the ears 128 against axial movement and thereby to lock the plugs 114 and 116 in their respective openings 118 and 120. The ears 128 may be moved into the locked position by twisting plugs 114 and 116 in the clockwise direction and may be moved out of the locked position by twisting the plugs 114 and 116 in the counterclockwise position. When the ears 128 are in the unlocked position, the plugs 114 and 116 may be slid axially in their openings 118 and 120, but when the ears 128 are twisted into the locked position, such axial movement is blocked.

Figure 7:
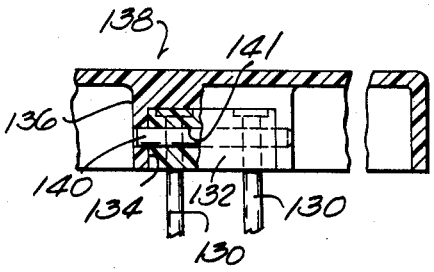
FIG. 7 is a fragmentary cross-sectional view of the central portion of another embodiment of the invention.

FIG. 7 shows a different embodiment in which a pair of spikes 130 are held in a plug 132 which is fitted into an opening 134 in a hub 136 of a flat plate 138. Plug 132 is held in place within opening 134 by a latching pin 140 which extends through latching openings 141 in plug 132 and hub 136.

Figure 9:
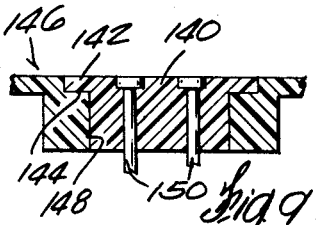
FIG. 9 is a fragmentary cross-sectional view of the central portion of another embodiment of the invention.

In FIG. 9, a plug 140 is shown which has a flange 142 that overlies a recess 144 in a flat plate 146 and extends through an opening 148 therein. A pair of spikes 150 extend through plug 140 and project downwardly therefrom. The heads of spikes 150 engage the top of plug 140 and hold the plate 146 down by the contact between flange 142 and recess 144.

Figure 10:
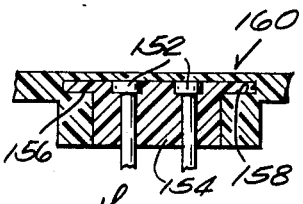
FIG. 10 is a fragmentary cross-sectional view of the central portion of another embodiment of the invention.

In FIG. 10, a pair of spikes 152 are held in a plug 154 which has a flanged top edge 156. The plug 154 is T-shaped in cross-section and is slideable in a T-shaped slot 158 in a flat plate 160. The slot 158 preferably extends from one edge of plate 160 to its central region.

I claim:

1. A baseball base marker comprising a flat polygonal shaped plate having at least one opening in the central portion thereof, a plug dimensioned to removably fit within said opening, means for removably securing said plug to said plate within said opening, and at least two spikes of unequal length attached to said plug and projecting downwardly therefrom for securing said plate to the ground, said plate having recessed portions in its lower surface, said spikes being removably attached to said plug, and a clip attached within one of said recessed portions of said plate adapted to grip and hold said spikes within said recessed portion to store said spikes therein.

2. A base marker as defined in claim 1 wherein said opening and said plug are both cylindrical in shape, and wherein said means for removably securing said plug to said plate within said opening comprises matching screw threads formed on said plug and in the wall of said opening.

* * * * *